US010024336B2

(12) United States Patent
Obrecht et al.

(10) Patent No.: US 10,024,336 B2
(45) Date of Patent: Jul. 17, 2018

(54) COMPRESSOR CASING COMPRISING CAVITIES WITH OPTIMISED SETTING

(71) Applicant: SNECMA, Paris (FR)

(72) Inventors: Thierry Jean-Jacques Obrecht, Melun (FR); Celine Ghilardi, Courbevoie (FR); Vincent Perrot, Maisons Alfort (FR)

(73) Assignee: SNECMA, Paris (FR)

( * ) Notice: Subject to any disclaimer, the term of this patent is extended or adjusted under 35 U.S.C. 154(b) by 496 days.

(21) Appl. No.: 14/390,178

(22) PCT Filed: Apr. 15, 2013

(86) PCT No.: PCT/FR2013/050828

§ 371 (c)(1),
(2) Date: Oct. 2, 2014

(87) PCT Pub. No.: WO2013/156725

PCT Pub. Date: Oct. 24, 2013

(65) Prior Publication Data

US 2015/0078890 A1 Mar. 19, 2015

(30) Foreign Application Priority Data

Apr. 19, 2012 (FR) ..... 12 01159

(51) Int. Cl.
*F04D 29/52* (2006.01)
*F04D 29/16* (2006.01)
(Continued)

(52) U.S. Cl.
CPC ..... *F04D 29/526* (2013.01); *F04D 19/00* (2013.01); *F04D 29/164* (2013.01);
(Continued)

(58) Field of Classification Search
CPC .... F04D 29/526; F04D 29/541; F04D 29/542; F04D 29/164; F04D 29/685; F05D 2220/3216
See application file for complete search history.

(56) References Cited

U.S. PATENT DOCUMENTS 4,086,022 A 4/1978 Freeman et al.
4,540,335 A 9/1985 Yamaguchi et al.
(Continued)

FOREIGN PATENT DOCUMENTS

DE 31 47 713 6/1982
EP 1 134 427 9/2001
(Continued)

OTHER PUBLICATIONS

International Search Report dated Oct. 14, 2013 in PCT/FR13/050828 Filed Apr. 15, 2013.
U.S. Appl. No. 14/391,080, filed Oct. 7, 2014, Obrecht, et al.

*Primary Examiner* — Richard Edgar
*Assistant Examiner* — Michael Sehn
(74) *Attorney, Agent, or Firm* — Oblon, McClelland, Maier & Neustadt, L.L.P.

(57) ABSTRACT

A compressor for a turbine engine, including: a casing, at least one compressor stage including an impeller having stationary blades and an impeller having moving blades positioned downstream of the stationary blade impeller, and cavities in a thickness of the casing that are disposed along a circumference of the casing opposite the moving blades. The cavities, which are elongate and extend along a main direction of orientation, are closed upstream and downstream by upstream and downstream faces respectively, and an upstream border and a downstream border are formed at the intersections between same and the casing. The cavities are offset in relation to the moving blades to overlap the moving blade impeller in the upstream portion, thereby covering the upstream end thereof. The downstream border of the cavities is oriented parallel to the chord at the head of the moving blade.

6 Claims, 2 Drawing Sheets

(51) Int. Cl.
*F04D 29/54* (2006.01)
*F04D 29/68* (2006.01)
*F04D 19/00* (2006.01)

(52) U.S. Cl.
CPC ..... *F04D 29/541* (2013.01); *F04D 29/542* (2013.01); *F04D 29/685* (2013.01); *F05D 2220/3216* (2013.01)

(56) References Cited

U.S. PATENT DOCUMENTS

| | | | | |
|---|---|---|---|---|
| 4,781,530 | A * | 11/1988 | Lauterbach | F04D 27/0215 415/173.1 |
| 5,059,093 | A * | 10/1991 | Khalid | F01D 17/105 415/115 |
| 5,137,419 | A * | 8/1992 | Waterman | F04D 29/685 415/170.1 |
| 6,435,819 | B2 * | 8/2002 | Irie | 415/119 |
| 7,210,905 | B2 * | 5/2007 | Lapworth | F04D 29/526 415/220 |
| 2009/0041576 | A1 | 2/2009 | Guemmer et al. | |
| 2010/0034637 | A1 | 2/2010 | Guemmer | |
| 2012/0003085 | A1 * | 1/2012 | Agneray | F04D 27/0207 415/199.5 |

FOREIGN PATENT DOCUMENTS

| | | |
|---|---|---|
| EP | 2 025 945 | 2/2009 |
| EP | 2 151 582 | 2/2010 |

* cited by examiner

COMPRESSOR CASING COMPRISING CAVITIES WITH OPTIMISED SETTING

BACKGROUND OF THE INVENTION

Field of the Invention

The field of the present invention is that of propulsion and more particularly that of axial or axi-centrifugal compressors for a propulsion unit (turbojet engine or turboprop engine, referred to as turbine engines in the remainder of the description) and more specifically to highly loaded high-pressure compressors.

Description of the Related Art

Aeronautical turbine engines mainly consist of one or more compressors, in which the air sucked through the air inlet is compressed, by a combustion chamber in which the injected fuel is burnt, and then by a turbine in which the burnt gases are expanded in order to drive the compressor or compressors and finally by an ejection device. Aeronautical compressors consist of fins, or blades, that are rotated inside a casing that provides the airtightness of the air duct vis-à-vis the outside of the engine. It is known that the clearance existing between the ends of the movable blades of the compressor and the casing forming the internal wall of the airflow duct degrades the efficiency of the engine of the turbine engine. Furthermore, this clearance may in particular modify and degrade the functioning of the compressor until a "surge" phenomenon appears, which results from the shedding of the airflow from the surface of the blades. Controlling the flow of air at the end of the blades thus constitutes an essential aim for obtaining both good aerodynamic efficiency of the compressor and a sufficient margin against the surge phenomenon.

One approach that has been developed for limiting the impact of this unwanted flow between the end of the blade and the casing consists of hollowing out cavities disposed in the wall of the casing at the blade passage path. These cavities are placed opposite the blade or preferentially offset axially, in the direction of the upstream end of the engine, for the purpose of reinjecting the air flowing in the clearance between the blade and the casing, in the duct upstream of the blade in question. One example of such an embodiment is given in the patent application by the applicant that was published under the number FR 2940374.

The improvement afforded by this embodiment stems merely from an optimisation of the axial position of the cavities and the search for optimisation on other parameters of these cavities must be pursued in order to attempt to improve further the aerodynamic efficiency and/or the surge margin of the existing compressors.

BRIEF SUMMARY OF THE INVENTION

The object of the present invention is therefore to propose a compressor casing provided with cavities, with further improved aerodynamic performance.

To this end, the invention relates to a compressor for a turbine engine comprising a casing, at least one compressor stage consisting of a fixed-vane wheel and a movable-blade wheel positioned downstream of said fixed-vane wheel, and cavities hollowed out, so as not to communicate with one another, in the thickness of said casing from its internal face and disposed parallel to one another on a circumference of said casing opposite the passage path of the movable blades, said cavities having an elongate shape in a principal orientation direction and being closed towards the upstream side and towards the downstream side by an upstream face and by a downstream face respectively, the intersections of which with the casing form an upstream boundary and a downstream boundary respectively, said cavities being offset with respect to the movable blades so as to project towards the upstream side of the movable-blade wheel while covering the upstream end thereof, characterised in that the downstream boundary of these cavities is oriented parallel to the chord at the head of the movable blade.

The parallelism between the downstream boundary of the cavities and the chord of the blade, by creating a thrust effect that arrives at the same moment over the entire downstream region of the cavity, causes a reduction in the clearance vortex associated with the passage of the blade and provides an increase in the surge margin and a slight improvement in the efficiency of the compressor stage.

Advantageously, the direction of orientation of said cavities is perpendicular to that of the chord of the movable blades. The substantially parallelepipedal shape of the cavity makes it possible to fully use the thrust effect indicated above.

In a particular embodiment the cavities are distributed evenly over the circumference of the casing.

In another embodiment the cavities are distributed unevenly over the circumference of the casing.

The invention also relates to a turbine engine comprising a compressor as described above.

BRIEF DESCRIPTION OF THE SEVERAL VIEWS OF THE DRAWINGS

The invention will be better understood, and other aims, details, features and advantages thereof will emerge more clearly during the following detailed explanatory description of an embodiment of the invention given by way of purely illustrative and non-limitative example, with reference to the accompanying schematic drawings.

In these drawings.

DETAILED DESCRIPTION OF THE INVENTION

Figure 1:
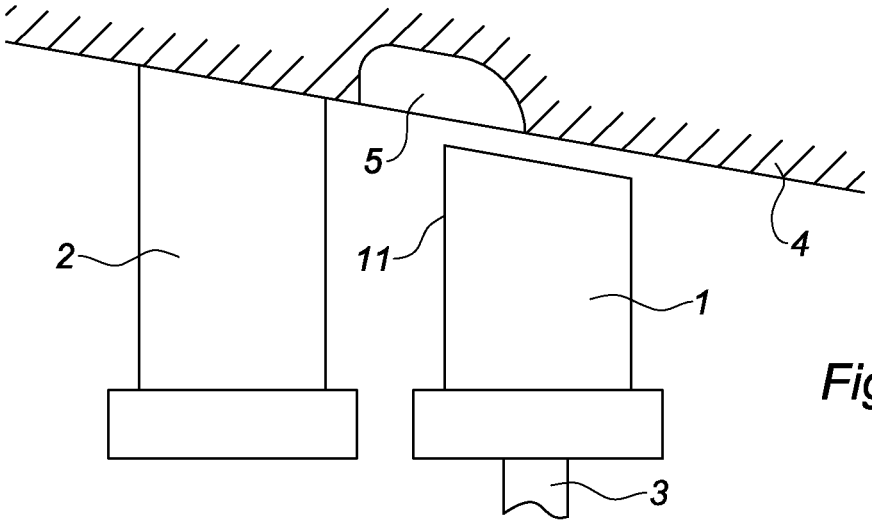
FIG. 1 is a schematic cross section of a compressor stage, the casing of which has a cavity for recirculating the air flowing between the blade and the casing.

Referring to FIG. 1, a compressor stage can be seen comprising a stator vane, or fixed vane 2, positioned upstream of a rotor blade, or movable blade 1, attached to a disc 3 (or directly secured to this disc according to a technology known as single-piece vaned disc technology). The fixed vanes are held in place by fixing on a compressor casing 4, which surrounds the movable blades 1, leaving a predefined clearance with them.

The casing 4 is hollowed out, from its internal face, with multiple cavities 5, not communicating with one another, which are evenly disposed on its circumference, opposite the passage path of the movable blades 1. These cavities are, roughly, in the form of a right-angled parallelepiped that is sunk radially into the casing and has, in cross section in an axial plane, the form of a rectangle with rounded corners. Their shape, in cross section in a plane tangent to the circumference of the casing 4, is, for its part, substantially that of an elongate rectangle extending along two large sides and comprising, upstream and downstream, two small sides forming so-called upstream 7 and downstream 6 boundaries. These two boundaries are conventionally segments of a straight line.

As can be seen in FIG. 1, the cavities are offset towards the upstream end of the engine, with respect to the leading edge of the movable blade 1. The length by which the upstream side 7 of the cavity projects with respect to the leading edge 11 of the blades is however limited by the space existing between the movable-blade wheel 1 and the fixed-vane wheel 2. Because of these cavities, the stray air is sucked at a certain percentage of the chord of the blade and reinjected into the duct upstream of the blade. This configuration allows recirculation of the air that passes in the clearance between the blade 1 and the casing 4; this clearance may in fact be the site of violent turbulences that would disturb the configuration of the flow between the various stages and which therefore could cause degradation of the performance of the compressor or, in the extreme, cause a so-called "surge" or "shedding" phenomenon. Such a phenomenon is characterised by an instantaneous drop in the compression ratio and a transient reversal of the air flow passing through the compressor, which then emerges through the upstream end of the compressor.

Figure 2:
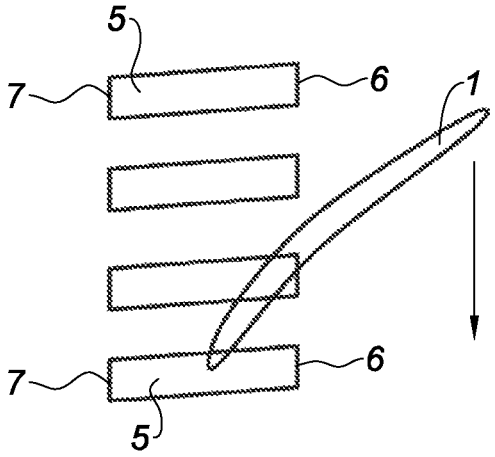
Fig. 2 PRIOR ART
FIG. 2 is a schematic plan view of a rotor blade and a casing according to the prior art.
Figure 3:
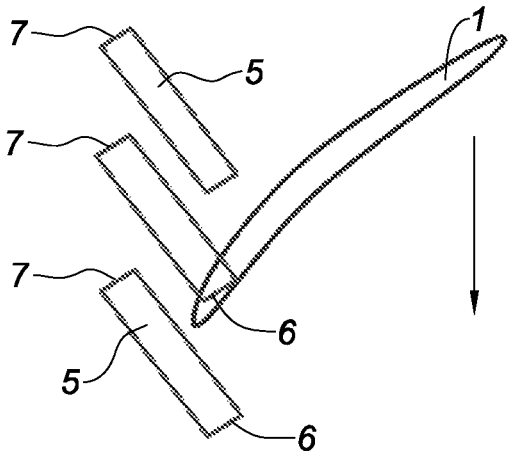
FIG. 3 is a schematic plan view of a rotor blade and a casing according to an embodiment of the invention.

Referring now to FIGS. 2 and 3, the circumferential position of a series of cavities 5 aligned along the casing 4 can be seen. The number of cavities is very much greater than the number of blades 1 constituting the movable wheel of the compressor stage. This number is in practice between 2 and 4 times the number of movable blades 1. The circumferential distribution of the cavities, as shown in the figures, is a uniform arrangement; it has moreover already been proposed to make this arrangement irregular in order to break up the aerodynamic excitation on the bladings that could be caused by these cavities, in particular at the ends of each of the two half-shells that constitute the casing.

In FIG. 2, depicting the prior art, the axis of these cavities is slightly inclined with respect to the longitudinal direction of the engine, defined as the rotation axis of the movable wheel 1 and illustrated by an arrow in the figure. On the other hand, in FIG. 3, which shows an embodiment of the invention, the cavities 5 are positioned with the principal orientation of their large sides considerably more tangential than in FIG. 2, and which is characterised by a setting angle perpendicular to the chord of the movable blades 1. The chord of a blade is defined as being the straight line joining its leading edge to its trailing edge. And, because the cavity has, in the example depicted, a substantially parallelepipedal shape, the downstream boundary 6 of the cavity 5 is aligned with this chord of the movable blades.

Figure 4:
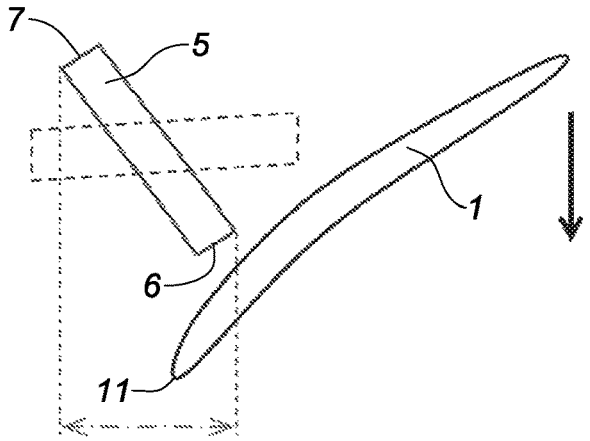
FIG. 4 is a comparative schematic view of the positioning of a cavity and a blade in the invention and in the prior art.

As a result, as can be seen in FIG. 4, the axial size of the cavities is considerably reduced with respect to the prior art (illustrated in broken lines in the figure). Among the beneficial consequences of this configuration there are, firstly, the fact that the additional mass due to the thickening of the casing in line with the cavities is less. It is necessary in fact to reinforce the casing 4 in line with these cavities 5 in order to take into account their impact on the mechanical strength of the casing. There is found, secondly, a reduction in the risk of aerodynamic interaction of the cavity 5 with the fixed blade 2 preceding the movable wheel 1; such an interaction will have the effect of a reduction in the improvement of the performance afforded by the cavity.

Figure 5:
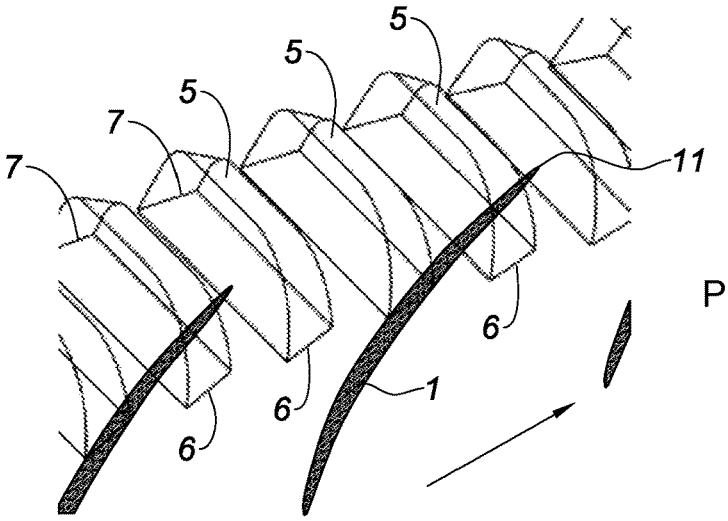
Fig. 5 PRIOR ART
FIG. 5 is a perspective view of the cavities and blades of a rotor according to the prior art.
Figure 6:
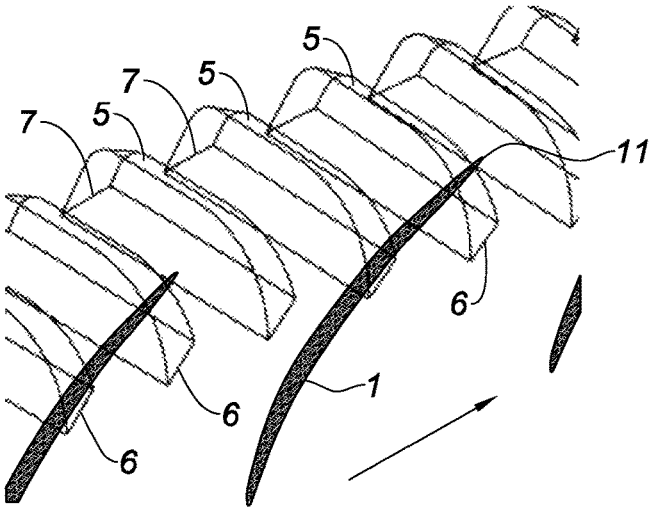
FIG. 6 is a perspective view of the cavities and blades of a rotor according to the invention.

FIGS. 5 and 6 show in perspective, and recessed, the relative position of the cavities 5 with respect to a movable-blade wheel 1, in the prior art and according to the invention respectively. As before, it can be seen that the invention is characterised by an orientation of the principal direction of the cavity 5 that is perpendicular to that of the chord of the movable blades 1. To take into account the case in which the cavity 5 is not in the form of a right-angled parallelepiped with rounded shapes, as illustrated in the figures, the principal feature of the invention is defined mainly as a parallelism between the downstream boundary 6 of the cavity 5 and the chord of the blade 1. The downstream boundary of a cavity, when it is not rectilinear, is for its part defined as the straight-line segment connecting the downstream extreme points of the large sides forming the intersection of the cavity with the internal wall of the casing 4.

The contribution of the invention will now be explained by stating first of all the operating principle of the treatments of casings by embedding cavities 5 in the thickness thereof. Two aerodynamic effects are combined: firstly, the suction of the air at the leading edge at the top of the rotor makes it possible to counter the development of the clearance vortex between the rotor and the casing, which gains in efficiency and in the stability limit against the phenomenon of surge; secondly, the reinjection of air upstream of the movable wheel makes it possible, through a re-energisation of the limit layer, to gain in the stability limit, and therefore in the surge margin.

It is considered in general that it is necessary to take into account three particular parameters for obtaining the best result with a casing treatment by incorporation of cavities 5. The first concerns the axial position of the downstream end of the cavity, which defines the point where the air is sucked in, the second, the axial position of the upstream end of the cavity, which defines the point where the air is reinjected, and the third, the volume of the cavity, which determines the quantity of air taken off and reinjected, and therefore the efficacy of the casing treatment.

The invention has sought first of all to reduce the axial extension of the cavities and for this reason has analysed the influence of the setting of these on the performance of the compressor. The reduction in the axial outline of the cavity by increasing the setting causes a bringing together both of the downstream side of the cavity and the reinjection point of the leading edge 11, but it is done here by preserving the volume of the cavity, which makes it possible to maintain the efficacy associated with the casing treatment through an embedding of cavities.

The invention then set out to determine the optimum angle of inclination for the setting of the cavities. This is because an excessively large angle tends to bring the take-off point too close to the leading edge of the blade, and therefore to effect it at a point where the pressure difference between the pressure face and the suction face is not yet great, which would not prevent the clearance vortex from developing a little further downstream. Likewise, the reinjection of air would be too close to the leading edge, and the mixing between the main upstream air and the air reinjected (tangentially) would not yet be established at the leading edge of the blade, which would be detrimental from the point of view of the stability of the flow. Finally, an excessively inclined cavity would lead to an excessively great angle of reinjection of the air, that is to say to an axial speed of the reinjected air that is too low, impairing the efficacy thereof.

It has been found that the optimum setting angle of the cavity is that which makes it possible to have the downstream boundary 6 of the cavity 5 aligned with the setting of the movable blade 1. The explanation of this optimum can be given by the fact that, when the blade passes above the cavity, the blade "pushes" the air flow into the cavity. Having a downstream boundary aligned with the setting of the blade makes it possible to have this first effect that arrives at the same moment over the entire downstream regions of the cavity. This causes a more effective thrust at the optimum moment, when the blade passes at the downstream side of the cavity, and this thrust effect causes the reduction in the clearance vortex associated with the passage of the blade.

Finally, the invention represents firstly an optimisation of the axial position of the start and end of the cavity with respect to the leading edge of the blade, associated with the maintenance of a sufficient volume of the cavity to ensure efficacy of the casing treatment, and, secondly, a reduction in the axial size of the cavities, the effect of which is a limitation on the excess thickness of the casing necessary for the integration of these.

The invention claimed is:

1. A compressor for a turbine engine comprising:

a casing;

at least one compressor stage including a fixed-vane wheel and a movable-blade wheel positioned downstream of the fixed-vane wheel, a flow of air passing through the compressor following an upstream-to-downstream direction; and cavities hollowed out, so as not to communicate with one another, in a thickness of the casing from an internal face of the casing and disposed parallel to one another on a circumference of the casing opposite a passage path of the movable blades, the cavities having, in cross section in a plane tangent to a circumference of the casing, an elongate shape in a principal orientation direction and each cavity being, when considering an upstream to downstream direction from the fixed-vane wheel to the movable-blade wheel, closed respectively towards an upstream side by an upstream face and towards a downstream side by a downstream face, and the shape of the cavities, in cross section in the plane tangent to the circumference of the casing, comprising an upstream boundary being a segment of a straight line and a downstream boundary being a segment of a straight line, the cavities being offset with respect to the movable blades to project towards the upstream side of the movable-blade wheel while covering the upstream end thereof, wherein the downstream boundary of the cavities is oriented to parallel to a chord, which is a straight line joining a leading edge of the blade to a trailing edge of the blade, at a head of the movable blade.

2. A compressor according to claim 1, wherein a direction of orientation of the cavities is perpendicular to that of the chord at a head of the movable blades.

3. A compressor according to claim 1, wherein the cavities are distributed evenly over the circumference of the casing.

4. A compressor according to claim 1, wherein the cavities are distributed unevenly over the circumference of the casing.

5. A turbine engine comprising a compressor according to claim 1.

6. A compressor according to claim 1, wherein in a cross section in an axial plane, the cavities have a shape of a rectangle with rounded corners between large sides and small sides of the rectangle.

* * * * *